US011053779B2

(12) United States Patent
Zhao et al.

(10) Patent No.: US 11,053,779 B2
(45) Date of Patent: Jul. 6, 2021

(54) HYDRATE SOLID-STATE FLUIDIZATION MINING METHOD AND SYSTEM UNDER UNDERBALANCED REVERSE CIRCULATION CONDITION

(71) Applicant: SouthWest Petroleum University, Sichuan (CN)

(72) Inventors: Jinzhou Zhao, Sichuan (CN); Na Wei, Sichuan (CN); Haitao Li, Sichuan (CN); Liehui Zhang, Sichuan (CN); Shouwei Zhou, Sichuan (CN); Qingping Li, Sichuan (CN); Wantong Sun, Sichuan (CN)

(73) Assignee: SOUTHWEST PETROLEUM UNIVERSITY, Sichuan (CN)

( * ) Notice: Subject to any disclaimer, the term of this patent is extended or adjusted under 35 U.S.C. 154(b) by 49 days.

(21) Appl. No.: 16/604,109

(22) PCT Filed: Nov. 20, 2018

(86) PCT No.: PCT/CN2018/116458
§ 371 (c)(1),
(2) Date: Oct. 9, 2019

(87) PCT Pub. No.: WO2019/223266
PCT Pub. Date: Nov. 28, 2019

(65) Prior Publication Data

US 2020/0291754 A1 Sep. 17, 2020

(30) Foreign Application Priority Data

May 25, 2018 (CN) ..... 201810515238.6

(51) Int. Cl.
*E21B 7/128* (2006.01)
*E21B 7/18* (2006.01)
(Continued)

(52) U.S. Cl.
CPC ..... *E21B 41/0099* (2020.05); *E21B 7/128* (2013.01); *E21B 7/185* (2013.01);
(Continued)

(58) Field of Classification Search
CPC ..... E21B 7/128; E21B 7/185; E21B 21/085; E21B 21/12; E21B 41/0099; E21B 43/01;
(Continued)

(56) References Cited

U.S. PATENT DOCUMENTS

2003/0136585 A1* 7/2003 Matsuo ..... E21B 43/29 175/69
2019/0211654 A1* 7/2019 Guo ..... B63B 35/4413

FOREIGN PATENT DOCUMENTS

CN 101435327 A 5/2009
CN 104948144 A 9/2015
(Continued)

*Primary Examiner* — Matthew R Buck
(74) *Attorney, Agent, or Firm* — Muncy, Geissler, Olds & Lowe, P.C.

(57) ABSTRACT

A hydrate solid-state fluidization mining method and system under an underbalanced reverse circulation condition are used for solid-state fluidization mining on a non-rock-forming weak-cementation natural gas hydrate layer in the ocean. Equipment includes a ground equipment system and an underwater equipment system. The construction procedure includes an earlier-stage construction process, pilot hole drilling construction process, reverse circulation jet fragmentation process, underbalanced reverse circulation fragment recovery process and silt backfilling process. Natural gas hydrates in the seafloor are mined through an underbalanced reverse circulation method. Problems such as shaft safety, production control and environmental risks faced by conventional natural gas hydrate mining methods such as depressurization, heat injection, agent injection and replacement are effectively solved. By using the method, the weak-cementation non-rock-forming natural gas hydrates in
(Continued)

the seafloor can be mined in environment-friendly, efficient, safe and economical modes, more energy resources can be provided, and energy shortage dilemmas are solved.

7 Claims, 2 Drawing Sheets

(51) Int. Cl.

| | |
|---|---|
| ***E21B 21/08*** | (2006.01) |
| ***E21B 21/12*** | (2006.01) |
| ***E21B 41/00*** | (2006.01) |
| ***E21B 43/01*** | (2006.01) |
| ***E21B 43/16*** | (2006.01) |
| ***E21B 43/26*** | (2006.01) |
| ***E21B 43/29*** | (2006.01) |
| ***E21B 43/38*** | (2006.01) |
| *E21B 33/14* | (2006.01) |

(52) U.S. Cl.
CPC ..... *E21B 21/085* (2020.05); *E21B 21/12* (2013.01); *E21B 43/01* (2013.01); *E21B 43/166* (2013.01); *E21B 43/26* (2013.01); *E21B 43/29* (2013.01); *E21B 43/38* (2013.01); *E21B 43/385* (2013.01); *E21B 33/14* (2013.01)

(58) Field of Classification Search
CPC ..... E21B 43/166; E21B 43/26; E21B 43/29; E21B 43/38; E21B 43/385
See application file for complete search history.

(56) References Cited

FOREIGN PATENT DOCUMENTS

| | | | |
|---|---|---|---|
| CN | 106761588 | A | 5/2017 |
| CN | 107642346 | A | 1/2018 |
| CN | 108049845 | A | 5/2018 |
| CN | 108756828 | A | 11/2018 |
| JP | 2006265850 | A | 10/2006 |

* cited by examiner

HYDRATE SOLID-STATE FLUIDIZATION MINING METHOD AND SYSTEM UNDER UNDERBALANCED REVERSE CIRCULATION CONDITION

TECHNICAL FIELD

The present invention relates to the technical field of unconventional oil and gas resource development, in particular to a hydrate solid-state fluidization mining method and system wider underbalanced reverse circulation condition.

BACKGROUND

Natural gas hydrate is a non-stoichiometric cage crystal formed by water and natural gas in high pressure and low temperature environments, and is thus of a high-density and high-calorific-value unconventional energy source. The natural gas hydrate (hereinafter referred to as "hydrate") has been attracting attention as a new type of clean energy. The global conservative estimate of marine hydrate reserves is $2.83\times10^{15}$ $m^3$, which is about 100 times of terrestrial resources. Therefore, the hydrate is considered to be the most promising alternative energy source in the 21st century. The Ministry of Land and Resources and other departments explored that the amount of China's prospective resources was about $680\times1.0^8$ t.

For the mining of marine hydrates, conventional methods use depressurization, heat injection, agent injection, displacement and other manners to cause the hydrates to release natural gas at the bottom of the well and mine the natural gas out. The basic principle of such methods is to decompose the hydrates into natural gas by means of depressurization, heat injection, agent injection, replacement and other technical means and then to mine the natural gas decomposed by the hydrates by conventional methods for mining natural gas. During the process of hydrate mining by depressurization, heat injection, agent injection, displacement, etc., sand particles generated by hydrate decomposition are carried into the shaft by natural gas, which causes the shaft safety problem during sand production at the bottom of the well. After the reservoir hydrate is decomposed, the original skeleton structure of the reservoir collapses and the formation stress field changes, resulting in production control risks such as collapse of the shaft and reservoir, as well as mining equipment being buried. The hydrate is decomposed into a large amount of natural gas, and the natural gas passes through the formation along pore channels of the formation and escapes from the sea surface into the atmosphere, resulting in various environmental risks. The problems of shaft safety, production control, and environmental risks faced by conventional hydrate mining methods are extremely serious. There is an urgent need for a mining method that can solve such problems faced by marine natural gas during the mining process.

SUMMARY

An objective of the present invention is to overcome the defects of the prior art, and to provide an environment-friendly, high-efficient, safe and economic hydrate solid-state fluidization mining method and system under an underbalanced reverse circulation condition.

Solution of the Problems

Technical Solution

To fulfill said objective, the present invention is implemented by the following technical solution:

the hydrate solid-state fluidization mining method under an underbalanced reverse circulation condition mainly comprises the following steps:

S1, an earlier-stage construction process: performing first spudding on a well by a conventional drilling mode, forming a shaft subjected to first spudding, setting a guide pipe, injecting cement to an annulus between the shaft subjected to first spudding and the guide pipe to form a cement ring, and installing a packer on the guide pipe;

S2, a pilot hole drilling construction process: after the guide pipe and the packer are installed, setting an oil pipe, drilling a pilot hole by adopting an underbalanced drilling mode according to a track design requirement, and taking a drill bit out after the drilling;

S3, a reverse circulation jet fragmentation process: setting the oil pipe down to the wellbore again and injecting seawater, performing high-pressure jet fragmentation on a hydrate reservoir, and storing hydrate particles formed by the fragmentation and silt in a cavity formed by jet;

S4, an underbalanced reverse circulation fragment recovery process: injecting mixed fluid of seawater and natural gas into the pilot hole and forming an underpressure at the bottom of the well; performing prefractionation on fragments formed in S2, mining hydrate particles and part of silt out along with the mixed fluid, and backfilling the remaining silt to the bottom of the well; separating the mixed stream of the mined hydrate particles and silt to obtain natural gas, seawater and silt;

S5, after the process S3 is performed for a while, performing the process S2 again, and repeating the reverse circulation jet fragmentation process and the underbalanced reverse circulation fragment recovery process till reaching a designed well depth; and S6, a silt backfilling process: injecting the mined silt and seawater into the pilot hole, forming a certain overpressure at the bottom of the well to achieve backfilling of the silt in a mined bed, and meanwhile, dragging the oil pipe upwards slowly to complete the backfilling of the entire shaft.

In order to implement the above method, the present invention further provides a mining system for the hydrate solid-state fluidization mining method under an underbalanced reverse circulation condition. The system is mainly composed of a ground equipment system and an underwater equipment system.

The ground equipment system mainly comprises a drilling machine, a ground separation system, a liquefaction system, a liquefied natural gas tank, an offshore platform, a sand feeding tank, a gas injection tank, a booster pump, a seawater injection pipeline, and a sea water pump; the drilling machine is installed on the offshore platform; the liquefied natural gas tank, a natural gas connecting pipe, the liquefaction system and the ground separation system are connected in sequence; the ground separation system is connected to the underwater system; the booster pump is connected to the gas injection tank; the seawater pump, the gas injection tank and the sand feeding tank are respectively connected to the seawater injection pipeline; a valve G is installed on the seawater injection pipeline; the seawater injection pipeline is connected into the underwater system; the underwater system comprises a coiled tubing outer tube, a coiled tubing inner tube, a drill bit, an underwater separator, a jet nipple, a pilot hole, a rotary guiding system, and a pilot hole drill bit; the coiled tubing outer tube is disposed inside the coiled tubing outer tube; the rotary guiding system is connected to the lower end of the coiled tubing inner tube in the pilot hole drilling construction process; the pilot hole drill bit is connected to the lower end of the rotary guiding system; the coiled tubing inner tube and the coiled tubing outer tube are respectively connected to an inner tube and an outer tube of the jet nipple in the reverse circulation jet fragmentation process, the underbalanced reverse circulation fragment recovery process and the silt backfilling process; the lower end of the jet nipple is connected to the underwater separator; and the lower end of the underwater separator is connected to the drill bit.

In a further preferred solution of the present invention, the liquefied natural gas tank and the liquefaction system are connected through a liquefaction system and liquefied natural gas tank connecting pipe; a valve C is installed on the liquefaction system and liquefied natural gas tank connecting pipe; the liquefaction system and the ground separation system are connected through a separation system and liquefaction system connecting pipe; a valve B is installed on the separation system and liquefaction system connecting pipe.

In a further preferred solution of the present invention, in the reverse circulation jet fragmentation process, the underbalanced reverse circulation fragment recovery process and the silt backfilling process, the ground separation system is connected to an inlet of the coiled tubing inner tube through a seawater recovery pipeline; a valve A is installed on the seawater recovery pipeline; an outlet end of the seawater pump is connected to the seawater injection pipeline; and the other end of the seawater injection pipeline is connected to an outlet of the coiled tubing outer tube.

In a further preferred solution of the present invention, in the pilot hole drilling construction process, the ground separation system is connected to the outlet of the coiled tubing outer tube through the seawater recovery pipeline; the outlet end of the seawater pump is connected to the seawater injection pipeline; and the other end of the seawater injection pipeline is connected to an inlet of the coiled tubing inner tube.

In a further preferred solution of the present invention, an inlet end of the seawater pump is connected to a seawater suction pipe; the middle of the seawater suction pipe is connected with the sand feeding tank through a sand feeding pipeline; and a valve D is installed in the middle of the sand feeding pipeline.

In a further preferred solution of the present invention, the booster pump and the gas injection tank are connected through a booster pump and gas injection tank connecting pipe, and a valve F is disposed on the booster pump and gas injection tank connecting pipe; an outlet end of the gas injection pipe is connected to the gas injection pipeline, and a valve E is disposed on the gas injection pipeline and connected to the seawater injection pipeline.

In a further preferred solution of the present invention, the underwater system further comprises a packer, a guide pipe, a cement ring, and a shaft subjected to first spudding; the packer is installed on the guide pipe; the guide pipe is fixedly connected to the shaft subjected to first spudding through the cement ring; the coiled tubing outer tube and the coiled tubing inner tube pass through the packer and the guide pipe and enter the hydrate reservoir.

BENEFICIAL EFFECTS OF THE INVENTION

Beneficial Effects

The present invention has the following advantages: according to the solid-state fluidization mining method under the underbalanced reverse circulation condition, the production risks, such as collapse of the shaft and reservoir, and mining equipment being buried, faced by conventional natural gas hydrate mining methods such as depressurization, heat injection, agent injection and replacement are effectively solved. The problem of environment pollution caused by escape of natural gas decomposed from the hydrate is solved. By using this method, the weak-cementation non-rock-forming natural gas hydrates in the seafloor can be mined in environment-friendly, efficient, safe and economical modes.

BRIEF DESCRIPTION OF THE DRAWINGS

Description of the Drawings

Figure 1:
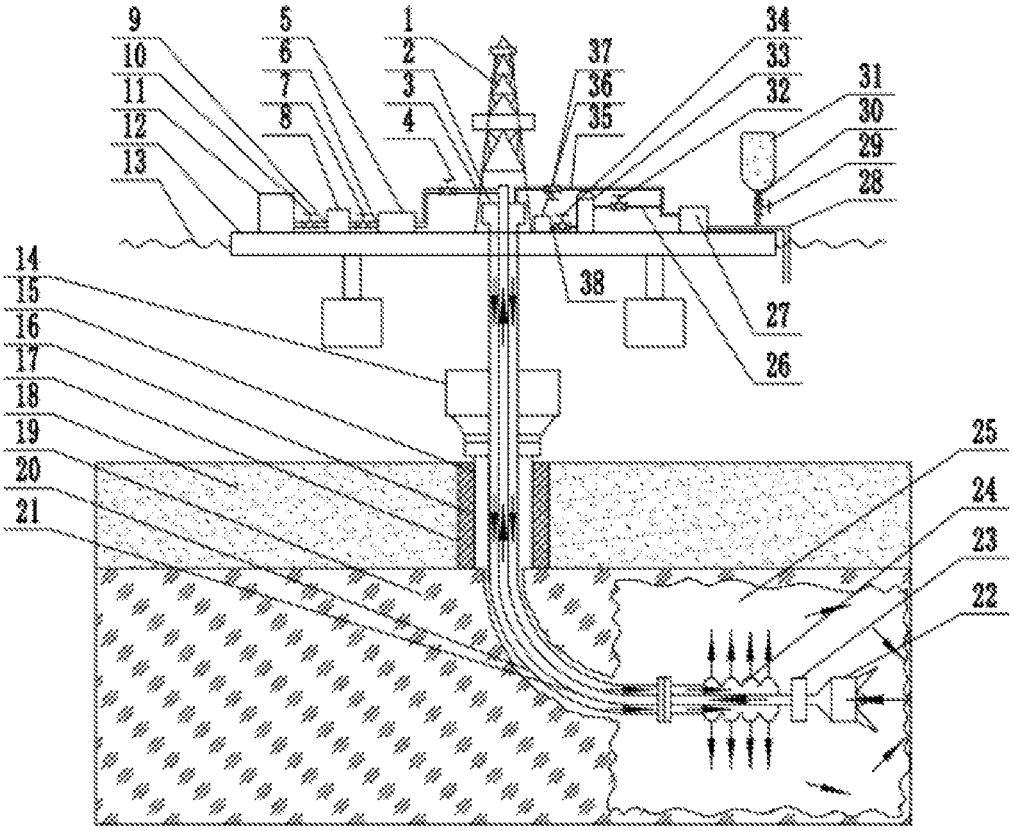
Figure 2:
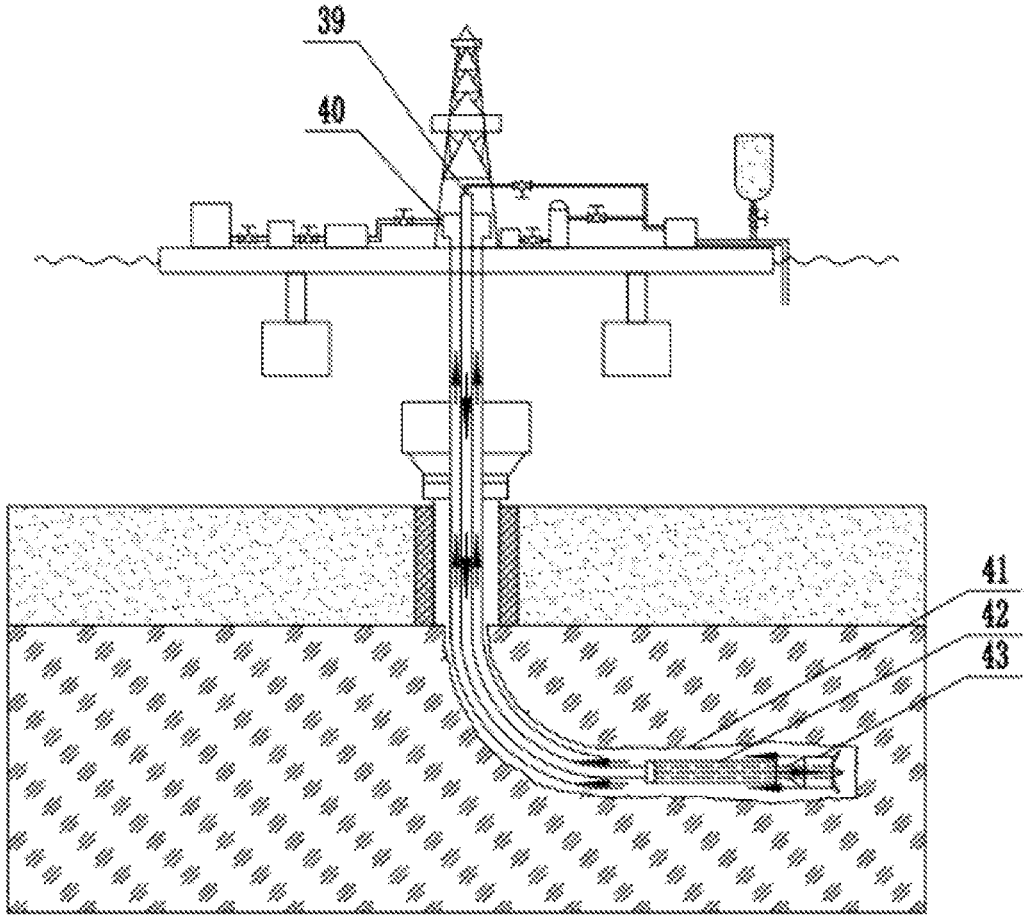

FIG. 1 is a schematic diagram of a jet fragmentation process, a fragment recovery process and a silt backfilling process and a system under an underbalanced reverse circulation condition;

FIG. 2 is a schematic diagram of a pilot hole drilling construction process; and in drawings, reference symbols represent the following components: 1—drilling machine; 2—injection joint; 3—seawater recovery pipeline; 4—valve A; 5—ground separation system; 6—separation system and liquefaction system connecting pipe; 7—valve B; 8—liquefaction system; 9—liquefaction system and liquefied natural gas tank connecting pipe; 10—valve C; 11—liquefied natural gas tank; 12—offshore platform; 13—sea surface; 14—packer; 15—guide pipe; 16—cement ring; 17—shaft subjected to first spudding; 18—formation; 19—hydrate reservoir; 20—coiled tubing outer tube; 21—coiled tubing inner tube; 22—drill bit; 23—underwater separator; 24—jet nipple; 25—cavity; 26—gas injection pipeline; 27—seawater pump; 28—seawater suction pipe; 29—valve D, 30—sand feeding pipeline; 31—sand feeding tank; 32—valve F; 33—gas injection pipe; 34—valve F; 35—seawater injection pipeline; 36—booster pump; 37—valve G, 38—booster pump and gas injection tank connecting pipe; 39—inlet of coiled tubing inner tube, 40—outlet of coiled tubing outer tube; 41—pilot hole; 42—rotary guiding system; 43—pilot hole drill bit.

DETAILED DESCRIPTION OF OPTIMAL EMBODIMENTS OF THE INVENTION

Optimal Embodiments of the Invention

The present invention will be further described below with reference to the accompanying drawings, but the protection scope of the present invention is not limited to the followings.

As shown in FIGS. 1-2, there is provided a mining system for a hydrate solid-state fluidization mining method under an underbalanced reverse circulation condition. The mining system is mainly composed of a ground equipment system and an underwater system.

The ground equipment system comprises a drilling machine 1, an injection joint 2, a seawater recovery pipeline 3, a ground separation system 5, a liquefaction system 8, a liquefied natural gas tank 11, an offshore platform 12, a sand feeding tank 31, a gas injection tank 33 and a booster pump 36.

The underwater equipment system comprises a coiled tubing outer tube 20, a coiled tubing inner tube 21, a drill bit 22, an underwater separator 23, a jet nipple 24, a pilot hole 41, a rotary guiding system 42 and a pilot hole drill bit 43. In addition, the underwater equipment system further comprises a packer 14, a guide pipe 15, a cement ring 16 and a shaft 17 subjected to first spudding.

The drilling machine 1 is installed on the offshore platform 12. The offshore platform 12 floats on a sea surface 13. The liquefied natural gas tank is connected to the liquefaction system 8 through a liquefaction system and liquefied natural gas tank connecting pipe 9. A valve C10 is installed in the middle of the liquefaction system and liquefied natural gas tank connecting pipe 9. The liquefaction system 8 and the ground separation system 5 are connected through a separation system and liquefaction system connecting pipe 6. A valve B7 is installed in the middle of the separation system and liquefaction system connecting pipe 6.

In the reverse circulation jet fragmentation process, the underbalanced reverse circulation fragment recovery process and the silt backfilling process, the ground separation system 5 is connected to an inlet of the coiled tubing inner tube 21 through a seawater recovery pipeline 3; a valve A4 is installed in the middle of the seawater recovery pipeline 3. In the pilot hole drilling construction process, the ground separation system 5 is connected to an outlet of the coiled tubing outer tube 20 through the seawater recovery pipeline 3. In the reverse circulation jet fragmentation process, the underbalanced reverse circulation fragment recovery process and the silt backfilling process, an outlet end of the seawater pump 27 is connected to the seawater injection pipeline 35, and the other end of the seawater injection pipeline 35 is connected to an outlet of the coiled tubing outer tube 20. In the meantime, a valve G37 is installed in the middle of the injection pipeline 26. The outlet of the coiled tubing outer tube 20 is installed on the injection joint 2. The injection joint 2 is installed on the coiled tubing outer tube 20. In the drilling construction process of a pilot hole 41, the outlet end of the seawater pump 27 is connected to the seawater injection pipeline 35, and the other end of the seawater pipeline is connected to an inlet of the coiled tubing inner tube 21. The inlet end of the seawater pump 27 is connected to a seawater suction pipe 28, and the other end of the seawater injection pipeline 35 is connected with an inlet of the coiled tubing inner tube 21. The inlet end of the seawater pump 27 is connected to the seawater suction pipe 28, the lower end of the seawater suction pipe 28 is located under the sea surface 13. The middle of the seawater suction pipe 28 is connected with the sand feeding tank 31 through a sand feeding pipeline 30, and a valve D29 is installed in the middle of the sand feeding pipeline 30. The booster pump 36 and the gas injection tank 33 are connected through a booster pump and gas injection tank connecting pipe 38, and a valve F34 is installed in the middle of the booster and gas injection tank connecting pipe 38. The outlet end of the gas injection tank 33 is connected to the gas injection pipeline 26, and a valve E32 is installed in the middle of the gas injection pipeline 26.

The packer 14 is installed on the guide pipe 15. The guide pipe 15 is fixedly connected to the shaft 17 subjected to first spudding through the cement ring 16. The shaft 17 subjected to first spudding is formed inside the formation 18 by first spudding. The coiled tubing outer tube 20 and the coiled tubing inner tube 21 pass through the packer 14 and the guide pipe 15 and enter the hydrate reservoir 19. The coiled tubing inner tube 21 is located inside the coiled tubing outer tube 20.

In the reverse circulation jet fragmentation process, the underbalanced reverse circulation fragment recovery process and the silt backfilling process, the coiled tubing inner tube 21 and the coiled tubing outer tube 20 are respectively connected to an inner tube and an outer tube of the jet nipple 24. The lower end of the jet nipple 24 is connected to the underwater separator 23, and the lower end of the underwater separator 23 is connected to the drill bit 22.

In the pilot hole drilling construction process, a rotary guiding system 42 is connected to the lower end of the coiled tubing inner tube 21, and the lower end of the rotary guiding system 42 is connected to the pilot hole drill bit 43.

A hydrate solid-state fluidization mining method under an underbalanced reverse circulation condition in the present invention comprises the following steps:

S1, an earlier-stage construction process: performing first spudding on a well by a conventional drilling mode, forming a shaft subjected to first spudding, setting a guide pipe, injecting cement to an annulus between the shaft subjected to first spudding and the guide pipe to form a cement ring, and installing a packer on the guide pipe;

S2, a pilot hole drilling construction process: after the guide pipe and the packer are installed, setting an oil pipe, drilling a pilot hole by adopting an underbalanced drilling mode according to a track design requirement, and taking a drill bit out after the drilling;

S3, a reverse circulation jet fragmentation process: setting an oil pipe down to the wellbore again and injecting seawater, performing high-pressure jet fragmentation on a hydrate reservoir, and storing hydrate particles formed by the fragmentation and silt in a cavity formed by jet;

S4, an underbalanced reverse circulation fragment recovery process: injecting mixed fluid of seawater and natural gas into the pilot hole and forming an underpressure at the bottom of the well; performing prefractionation on fragments formed in S2, mining hydrate particles and part of silt out along with the mixed fluid, and backfilling the remaining silt to the bottom of the well; separating the mixed stream of the mined hydrate particles and silt to obtain natural gas, seawater and silt;

S5, after the process S3 is performed for a while, performing the process S2 again, and repeating the reverse circulation jet fragmentation process and the underbalanced reverse circulation fragment recovery process till reaching a designed well depth; and S6, a silt backfilling process: injecting the mined silt and seawater into the pilot hole, forming a certain overpressure at the bottom of the well to achieve backfilling of the silt in a mined bed, and meanwhile, dragging the oil pipe upwards slowly to complete the backfilling of the entire shaft.

The specific implementation process of the method is as follows.

In the earlier-stage construction process: a well is subjected to first spudding by a conventional drilling mode to form a shaft 17 subjected to first spudding, and then a guide pipe 15 is set; cement is injected to an annulus between the shaft 17 subjected to first spudding and the guide pipe 15 to form a cement ring 16, and a packer 14 is installed on the guide pipe 15.

In the drilling construction process of the pilot hole 41: as shown in FIG. 2, after the guide pipe 15 and the packer 14 are installed, the coiled tubing outer tube 20 and the coiled tubing inner tube 21 are set; the rotary guiding system 42 and the pilot hole drill bit 43 are installed at the lower end of the coiled tubing inner tube 21 in sequence; when the pilot hole drill bit 43 is lowered to the top of the hydrate reservoir 19, drilling is stopped. Since the packer 14 is installed on the guide pipe 15, a flow channel between the guide pipe 15 and the coiled tubing outer tube 20 does not allow fluid to flow through. Then, a valve A4, a valve B7, a valve C10, a valve E32, a valve F34 and a valve G37 are opened respectively. The seawater pump 27, the booster pump 36, the ground separation system 5 and the liquefaction system 8 are turned on respectively. Natural gas in the gas injection tank 33 enters a seawater injection pipeline 35 via the gas injection pipeline 26 according to a desired underpressure at the bottom of the well. As indicated by a black arrow in FIG. 2, seawater enters the seawater pump 27 through the seawater suction pipe 28. Mixed fluid formed by seawater and natural gas flows through the seawater injection pipeline 35, the inlet of the coiled tubing inner tube 21 and the coiled tubing inner tube 21 in sequence, and then flows to the rotary guiding system 42. The high pressure fluid drives the rotary guiding system 42 to rotate. The rotary guiding system 42 drives the pilot hole drill bit 43 to rotate and break the hydrate reservoir 19. Since a flow pressure of the mixed fluid formed by the seawater and the natural gas in the coiled tubing inner tube 21 at the bottom of the well is lower than the pressure of the formation 18, a downhole leak does not occur in the formation 18. The mixed fluid flowing out from an inner hole of the pilot hole drill bit 43 returns to the inlet 39 of the coiled tubing inner tube along the annulus between the coiled tubing inner tube 21 and the coiled tubing outer tube 20. During the process of returning to the inlet 39 of the coiled tubing inner tube, the fragmented hydrate particles are decomposed into natural gas as the temperature rises and the pressure decreases. The mixed fluid enters the ground separation system 5 via the seawater recovery pipeline 3. Seawater, natural gas and silt are separated through the ground separation system 5. The separated natural gas enters the liquefaction system 8 through the separation system and liquefaction system connecting pipe 6. The liquefied natural gas liquefied by the liquefaction system 8 is injected into the liquefied natural gas tank 11 through the liquefaction system and liquefied natural gas tank connecting pipe 9. The separated silt is filled into the sand feeding tank 31, and the separated seawater is directly discharged into the sea. During the return of the mixed fluid along the annulus between the coiled tubing inner tube 21 and the coiled tubing outer tube 20, a portion of the mixed fluid is moved upward along the annulus between the coiled tubing outer tube 20 and the pilot hole 41. Since the packer 14 closes the upper flow channel and the fluid is forced to stop the movement while moving to the lower end of the packer 14, the fluid can only be moved upward through the annulus between the coiled tubing inner tube and the coiled tubing outer tube 20. In the process of drilling the pilot hole 41, the positive circulation underbalanced drilling method is adopted and combined with the rotary guiding technology, the pilot hole drilling procedure is completed according to a trake design requirement, and the pilot hole 41 is pulled out after drilling.

In the reverse circulation jet fragmentation process: as shown in FIG. 1, after the pilot hole is drilled, the coiled tubing outer tube 20 and the coiled tubing inner tube 21 are set. A jet nipple 24, an underwater separator 23 and a drill bit 22 are sequentially installed at the lower end of the coiled tubing inner tube 21 and the lower end of the coiled tubing outer tube 20. When the drill bit 22 is lowered to the entrance of a horizontal section of the pilot hole 41, the drilling is stopped. A valve A4, a valve B7, a valve C10 and a valve F34 are respectively opened respectively. The seawater pump 27 is started, and the seawater is sucked into the seawater pump 27 through the seawater suction pipe 28, and as shown by the black arrow in FIG. 1, flows through an outlet of the seawater pump 27, the seawater injection pipeline 35 and the annulus between the coiled tubing inner tube 21 and the coiled tubing outer tube 20 to the jet nipple 24. The jet nipple 24 performs high pressure jet fragmentation on the hydrate reservoir 19. The jet nipple 24 is slowly moved downward during the jet fragmentation to form a cavity 25. Since a formation pressure in the hydrate reservoir 19 is lower than a flow pressure at the jet nipple 24, a downhole leak is caused, such that the fragmented hydrate particles, silt and seawater mixture do not return to the ground or a small portion thereof passes through the inner hole of the drill bit 22 into the coiled tubing inner tube 21 and returns to the ground. The hydrated particles formed by the fragmentation and slit are stored in the cavity 25 formed by jetting.

In the underbalanced reverse circulation fragment recovery process: as shown in FIG. 1, the jet nipple 24 performs high pressure jet fragmentation on the hydrate reservoir 19 for a section of well depth, the valve E32 and the valve F34 are opened, and the booster pump 36 is started. According to a desired underpressure at the bottom of the well, the natural gas in the gas injection tank 33 enters the seawater injection pipeline 35, and as shown by the black arrow in FIG. 1, enters the annulus between the coiled tubing inner tube 21 and the coiled tubing outer tube 20 along with the seawater. After the mixed fluid of seawater and natural gas flows to the bottom of the well, a certain underpressure is formed at the bottom of the well. Since the formation pressure is higher than the flow pressure at the bottom of the well formed by the flowing of the mixed fluid, no downhole leak occurs in the formation 18. After the mixed fluid passes through the jet nipple 24, fragments formed in the cavity 25 are carried to the underwater separator 23 through the inner hole of the drill bit 22. The underwater separator 23 separates silt in the mixture and backfills it to the bottom of the well. The fluid separated by the underwater separator 23 returns to the inlet of the coiled tubing inner tube 21 along the coiled tubing inner tube 21. During the process of returning to the inlet of the coiled tubing inner tube 21, the fragmented hydrate particles are decomposed into natural gas as the temperature rises and the pressure decreases. The mixed fluid enters the ground separation system 5 via the seawater recovery pipeline 3. Seawater, natural gas and silt are separated through the ground separation system 5. The separated natural gas enters the liquefaction system 8 through the separation system and liquefaction system connecting pipe 6. The liquefied natural gas liquefied by the liquefaction system 8 is injected into the liquefied natural gas tank 11 through the liquefaction system and liquefied natural gas tank connecting pipe 9. The separated silt is filled into the sand feeding tank 31, and the separated seawater is directly discharged into the sea. After the fragments in the cavity 25 are subjected to underbalanced reverse circulation recovery, the reverse circulation jet fragmentation process is performed again, the reverse circulation jet fragmentation is performed for a certain section of well depth, and then the underbalanced reverse circulation fragment recovery process is performed. The reverse circulation jet fragmentation process is repeated until a designed well depth is reached.

In a slit backfilling process: as shown in FIG. 1, during the underbalanced reverse circulation fragment recovery process, a part of silt separated by the underwater separator 3 is directly backfilled to the seabed, and the remaining part of the silt is separated by the ground separation system 5. The silt separated by the ground separation system 5 is filled into the sand feeding tank 31. When fragments obtained by reverse circulation jet fragmentation is subjected to underbalanced reverse circulation recovery to reach a designed well depth, the valve E32 is closed, the operation of the booster pump 36 is stopped, and the valve D29 is opened. Under the action of siphon effect and gravity, the silt in the sand feeding tank 31 enters the seawater suction pipe 28 through the sand feeding pipeline 30. The silt entering the seawater suction pipe 28 flows through the sea water pump 27, the seawater injection line 35, the annulus between the coiled tubing inner tube 21 and the coiled tubing outer tube 20 in sequence and the jet nipple 24 and then into the cavity 25 along with the seawater. Since silt is mixed in the seawater, and a bottom hole pressure in the annulus between the coiled tubing inner tube 21 and the coiled tubing outer tube 20 is much higher than a bottom hole pressure of the hydrate reservoir 19, a downhole leak will occur. The fluid does not return to the ground, thereby achieving successful backfilling of the silt in the cavity 25. During the process of silt backfilling to the cavity 25, the coiled tubing inner tube 21 and the coiled tubing outer tube 20 are slowly pulled upwards at the same time, thereby finally completing the backfilling of the entire shaft.

According to the hydrate solid-state fluidization mining method under the underbalanced reverse circulation condition, the production risks, such as collapse of the shaft and reservoir, and mining equipment being buried, faced by conventional natural gas hydrate mining methods such as depressurization, heat injection, agent injection and replacement are effectively solved. The problem of environment pollution caused by escape of natural gas decomposed from the hydrate is solved. By using this method, the weak-cementation non-rock-forming natural gas hydrates in the seafloor can be mined in environment-friendly, efficient, safe and economical modes.

The above contents are only preferred embodiments of the present invention. It should be noted that a number of variations and modifications may be made by those common skilled in the art without departing from the concept of the present invention. All the variations and modifications should all fall within the protection scope of the present invention.

The invention claimed is:

1. A mining system for hydrate solid-state fluidization mining method under an underbalanced reverse circulation condition, wherein the hydrate solid-state fluidization mining method comprises the following steps:

S1, an earlier-stage construction process: performing first spudding on a well by a conventional drilling mode, forming a shaft subjected to the first spudding, setting a guide pipe, injecting cement to an annulus between the shaft subjected to the first spudding and the guide pipe to form a cement ring, and installing a packer on the guide pipe;

S2, a pilot hole drilling construction process: after the guide pipe and the packer are installed, setting an oil pipe, drilling a pilot hole by adopting an underbalanced drilling mode, and taking a drill bit out after the drilling;

S3, a reverse circulation jet fragmentation process: setting the oil pipe down to the wellbore again and injecting seawater, performing high-pressure jet fragmentation on a hydrate reservoir, and storing hydrate particles formed by the fragmentation and silt in a cavity formed by a jet;

S4, an underbalanced reverse circulation fragment recovery process: injecting a mixed fluid of seawater and natural gas into the pilot hole and forming an under pressure at the bottom of the well; performing prefractionation on fragments formed in S2, then mining the hydrate particles and part of silt out along with the mixed fluid, and backfilling the remaining silt to the bottom of the well; separating the mixed stream of the mined hydrate particles and the silt to obtain natural gas, seawater and silt;

S5, after the process S3 is performed for a period of time, performing the process S2 again, and repeating the reverse circulation jet fragmentation process and the underbalanced reverse circulation fragment recovery process till reaching a designed well depth; and S6, a silt backfilling process: injecting the mined silt and the seawater into the pilot hole, forming a certain overpressure at the bottom of the well to achieve backfilling of the silt in a mined bed, and meanwhile, dragging the oil pipe upwards slowly to complete the backfilling of the entire shaft, wherein the mining system comprise a ground equipment system and an underwater system;

the ground equipment system comprises a drilling machine, a ground separation system, a liquefaction system, a liquefied natural gas tank, an offshore platform, a sand feeding tank, a gas injection tank, a booster pump, a seawater injection pipeline, and a seawater pump; the drilling machine is installed on the offshore platform; the liquefied natural gas tank, the liquefaction system and the ground separation system are connected in sequence; the ground separation system is connected to the underwater system; the booster pump is connected to the gas injection tank; the seawater pump, the gas injection tank and the sand feeding tank are respectively connected to the seawater injection pipeline; a valve G is installed on the seawater injection pipeline; the seawater injection pipeline is connected to the underwater system;

the underwater system comprises a coiled tubing outer tube, a coiled tubing inner tube, a drill bit, an underwater separator, a jet nipple, the pilot hole, a rotary guiding system, and a pilot hole drill bit; the coiled tubing outer tube is disposed inside the coiled tubing outer tube; the rotary guiding system is connected to the lower end of the coiled tubing inner tube in the pilot hole drilling construction process; the pilot hole drill bit is connected to the lower end of the rotary guiding system; the coiled tubing inner tube and the coiled tubing outer tube are respectively connected to an inner tube and an outer tube of the jet nipple in the reverse circulation jet fragmentation process, the underbalanced reverse circulation fragment recovery process and the silt backfilling process; the lower end of the jet nipple is connected to the underwater separator; and the lower end of the underwater separator is connected to the drill bit.

2. The mining system for the hydrate solid-state fluidization mining method under the underbalanced reverse circulation condition according to claim 1, wherein the liquefied natural gas tank and the liquefaction system are connected through a liquefaction system and liquefied natural gas tank connecting pipe; a valve C is installed on the liquefaction system and liquefied natural gas tank connecting pipe; the liquefaction system and the ground separation system are connected through a separation system and liquefaction system connecting pipe; a valve B is installed on the separation system and liquefaction system connecting pipe.

3. The mining system for the hydrate solid-state fluidization mining method under the underbalanced reverse circulation condition according to claim 1, wherein in the reverse circulation jet fragmentation process, the underbalanced reverse circulation fragment recovery process and the silt backfilling process, the ground separation system is connected to an inlet of the coiled tubing inner tube through a seawater recovery pipeline; a valve A is installed on the seawater recovery pipeline; an outlet end of the seawater pump is connected to the seawater injection pipeline; and the other end of the seawater injection pipeline is connected to an outlet of the coiled tubing outer tube.

4. The mining system for the hydrate solid-state fluidization mining method under the underbalanced reverse circulation condition according to claim 1, wherein in the pilot hole drilling construction process, the ground separation system is connected to the outlet of the coiled tubing outer tube through the seawater recovery pipeline; the outlet end of the seawater pump is connected to the seawater injection pipeline; and the other end of the seawater injection pipeline is connected to the inlet of the coiled tubing inner tube.

5. The mining system for the hydrate solid-state fluidization mining method under the underbalanced reverse circulation condition according to claim 1, wherein an inlet end of the seawater pump is connected to a seawater suction pipe; the middle of the seawater suction pipe is connected with the sand feeding tank through a sand feeding pipeline; and a valve D is installed in the middle of the sand feeding pipeline.

6. The mining system for the hydrate solid-state fluidization mining method under the underbalanced reverse circulation condition according to claim 1, wherein the booster pump and the gas injection tank are connected through a booster pump and gas injection tank connecting pipe, and a valve F is disposed on the booster pump and gas injection tank connecting pipe; an outlet end of the gas injection pipe is connected to a gas injection pipeline, and a valve E is disposed on the gas injection pipeline and connected to the seawater injection pipeline.

7. The mining system for the hydrate solid-state fluidization mining method under the underbalanced reverse circulation condition according to claim 1, wherein the underwater system further comprises a packer, a guide pipe, a cement ring, and a shaft subjected to first spudding; the packer is installed on the guide pipe; the guide pipe is fixedly connected to the shaft subjected to first spudding through the cement ring; the coiled tubing outer tube and the coiled tubing inner tube pass through the packer and the guide pipe and enter the hydrate reservoir; and the coiled tubing inner tube is located inside the coiled tubing outer tube.

* * * * *